US012497728B2

(12) United States Patent
Kweon et al.

(10) Patent No.: US 12,497,728 B2
(45) Date of Patent: Dec. 16, 2025

(54) CLOTHES CARE APPARATUS

(71) Applicant: Samsung Electronics Co., Ltd., Suwon-si (KR)

(72) Inventors: Sang Young Kweon, Suwon-si (KR); Kwon Chul Yun, Suwon-si (KR); Min Wook Je, Suwon-si (KR); Jung Sang Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 546 days.

(21) Appl. No.: 17/577,122

(22) Filed: Jan. 17, 2022

(65) Prior Publication Data

US 2022/0136164 A1 May 5, 2022

Related U.S. Application Data

(63) Continuation of application No. PCT/KR2020/007638, filed on Jun. 12, 2020.

(30) Foreign Application Priority Data

Jul. 17, 2019 (KR) ..... 10-2019-0086549

(51) Int. Cl.
*D06F 58/26* (2006.01)
*D06F 39/14* (2006.01)
*D06F 58/10* (2006.01)

(52) U.S. Cl.
CPC ..... *D06F 58/10* (2013.01); *D06F 39/14* (2013.01); *D06F 58/26* (2013.01)

(58) Field of Classification Search
CPC ..... D06F 39/14; D06F 58/10; D06F 58/12
See application file for complete search history.

(56) References Cited

U.S. PATENT DOCUMENTS 4,494,683 A * 1/1985 Kleber ..... D06F 73/02 223/51
5,520,453 A * 5/1996 Aoki ..... F25D 23/02 49/504

(Continued)

FOREIGN PATENT DOCUMENTS

CN 208250736 U 12/2018
GB 2556071 A * 5/2018 ..... E06B 3/7003

(Continued)

OTHER PUBLICATIONS

International Search Report and Written Opinion of the International Searching Authority dated Oct. 6, 2020, in connection with International Application No. PCT/KR2020/007638, 9 pages.

*Primary Examiner* — Omair Chaudhri

(57) ABSTRACT

The present disclosure relates to a clothes care apparatus having a door support for increasing a rigidity of a door. The clothes care apparatus includes a cabinet including a clothes care compartment with an open front, and a machine compartment provided with a heat pump and a steam generator provided to heat or dehumidify air in the clothes care compartment, a door provided to open or close the opening of the cabinet, and a door support provided to reinforce a rigidity of the door, wherein the door support includes a first reinforcement provided to support the door in a longitudinal direction, and a second reinforcement connected to one side of the first reinforcement and provided such that at least a portion thereof is exposed to the outside of the door.

17 Claims, 16 Drawing Sheets

(56) References Cited

U.S. PATENT DOCUMENTS

| | | | | |
|---|---|---|---|---|
| 2007/0062226 | A1* | 3/2007 | Gomoll | A47F 3/0434 68/34 |
| 2009/0224637 | A1* | 9/2009 | Moon | D06F 58/20 312/109 |
| 2011/0101838 | A1* | 5/2011 | Tooker | D06F 39/14 312/326 |
| 2011/0121694 | A1* | 5/2011 | Kim | D06F 39/14 312/204 |
| 2011/0277334 | A1* | 11/2011 | Lee | D06F 58/206 34/73 |
| 2016/0194799 | A1* | 7/2016 | Nash | D06F 39/14 68/3 R |
| 2016/0265267 | A1* | 9/2016 | Sadeli | E06B 3/7001 |
| 2017/0342621 | A1* | 11/2017 | Chun | D06F 23/00 |
| 2018/0002853 | A1* | 1/2018 | Anand | D06F 39/14 |
| 2019/0145041 | A1* | 5/2019 | Bhandare | D06F 39/14 68/196 |
| 2021/0238793 | A1* | 8/2021 | Choi | B29C 44/1214 |
| 2023/0194155 | A1* | 6/2023 | Kang | H05B 47/175 315/130 |

FOREIGN PATENT DOCUMENTS

| | | | | |
|---|---|---|---|---|
| KR | 10-0666706 | B1 | 1/2007 | |
| KR | 10-2010-0121121 | A | 11/2010 | |
| KR | 101031336 | B1 * | 4/2011 | |
| KR | 10-2011-0067833 | A | 6/2011 | |
| KR | 10-1113883 | B1 | 2/2012 | |
| KR | 10-1141637 | B1 | 5/2012 | |
| KR | 10-1177475 | B1 | 8/2012 | |
| KR | 10-2014-0097799 | A | 8/2014 | |
| KR | 10-1435837 | B1 | 8/2014 | |
| KR | 20-0474612 | Y1 | 10/2014 | |
| KR | 10-1646510 | B1 | 8/2016 | |
| KR | 10-2018-0054538 | A | 5/2018 | |
| WO | WO-2018138946 | A1 * | 8/2018 | D06F 39/14 |

* cited by examiner

CLOTHES CARE APPARATUS

CROSS-REFERENCE TO RELATED APPLICATIONS

This application is a bypass continuation of International Application No. PCT/KR2020/007638, filed Jun. 12, 2020, which claims priority to Korean Patent Application No. 10-2019-0086549, filed Jul. 17, 2019, the disclosures of which are herein incorporated by reference in their entirety.

BACKGROUND

1. Field

The present disclosure relates to a clothes care apparatus, and more particularly, to a clothes care apparatus having an improved door structure.

2. Description of Related Art

In general, clothes care apparatuses refer to apparatuses for washing or drying laundry. Among these clothes care apparatuses, a clothes care apparatus having a drying function may include a hot air supply device configured to supply hot air to an accommodation space in which clothes are accommodated to dry the clothes, and may include a steam generator configured to perform a refresh function such as crease removal, odor removal, static electricity removal, etc. of clothes and the like.

The clothes care apparatus is configured in the form of a cabinet with an accommodation compartment for accommodating clothes. The accommodation compartment for accommodating clothes is provided at an upper portion of the cabinet, and a machine compartment equipped with a steam generator or the hot air supply device is provided at a lower portion of the cabinet. The accommodation compartment and the machine compartment may be separated by a partition.

The clothes care apparatus may be provided with a door to selectively open or close the accommodation compartment of the cabinet. The door is provided to form an exterior and prevent leakage of wet steam in the accommodation compartment.

Such a door may be twisted when assembled into the cabinet, or may be thermally deformed due to heat during operation of the clothes care apparatus.

SUMMARY

The present disclosure is directed to providing a clothes care apparatus having a door support for increasing a rigidity of a door.

The present disclosure is directed to providing a clothes care apparatus capable of preventing torsion and thermal deformation by securing a vertical rigidity of the door.

The present disclosure is directed to providing a clothes care apparatus having a door capable of improving an exterior (design) by diversifying materials.

An aspect of the present disclosure provides a clothes care apparatus including: a cabinet including a clothes care compartment with an open front, and a machine compartment provided with a heat pump and a steam generator provided to heat or dehumidify air in the clothes care compartment; a door provided to open or close the opening of the cabinet; and a door support provided to reinforce a rigidity of the door, wherein the door support includes a first reinforcement provided to support the door in a longitudinal direction, and a second reinforcement connected to one side of the first reinforcement and including an exposed portion exposed to the outside of the door.

The first reinforcement may include a steel material.

The second reinforcement may include at least one of steel, aluminum, and an injection-molded part.

The first reinforcement may be molded by a press method, and the second reinforcement may be molded by an extrusion method.

The door may include a door panel forming a front surface and a door frame assembly coupled to the door panel to form a rear surface, and the first reinforcement and the second reinforcement may be disposed between the door panel and the door frame assembly.

The second reinforcement may include a handle.

The door support may include a third reinforcement and a fourth reinforcement disposed to support the door in a transverse direction.

The third reinforcement and the fourth reinforcement may be disposed on the rear surface of the door frame assembly.

The first reinforcement and the second reinforcement may include a reinforcement assembly portion to be assembled with each other.

The first reinforcement and the second reinforcement may include a fixing portion to be fixed to the door frame assembly.

The first reinforcement may include at least one bead formed to protrude.

The first reinforcement may include a first assembling guide for guiding assembly with the door frame assembly.

The second reinforcement may further include a second assembling guide for guiding assembly with the first reinforcement.

The second reinforcement may further include a stopper provided to limit the movement of the first reinforcement when assembled with the first reinforcement.

The third reinforcement and the fourth reinforcement each may include at least one protrusion formed to protrude.

The clothes care apparatus may further include a heat insulator provided between the door panel and the door frame assembly.

At least one of the second reinforcement and the door frame assembly may include an adhesive for adhering the door panel.

Another aspect of the present disclosure provides a clothes care apparatus including: a cabinet in which a clothes care compartment is formed; a door installed in the cabinet to open or close the clothes care compartment; and at least one door support provided to reinforce a rigidity of the door, wherein the door support includes a first reinforcement of a steel material provided in a longitudinal direction of the door, and a second reinforcement connected to one side of the first reinforcement and provided such that at least a portion thereof is exposed to the outside of the door.

The second reinforcement may include at least one of steel, aluminum, and an injection-molded part.

The first reinforcement may be molded by a press method, and the second reinforcement may be molded by an extrusion method.

According to an embodiment of the present disclosure, the rigidity of a door can be secured.

Further, a vertical rigidity of the door can be secured, thereby preventing torsion due to assembly and thermal deformation due to operation.

Further, the beauty of the door can be improved with various materials.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
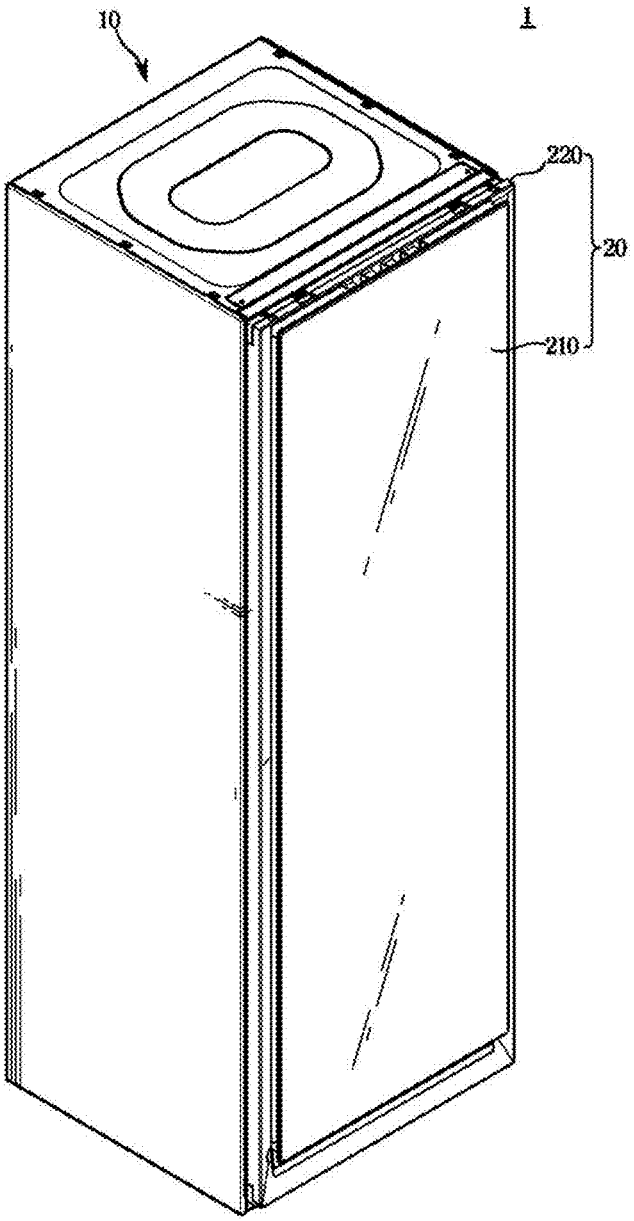
FIG. 1 is a perspective view of a clothes care apparatus according to an embodiment of the present disclosure.

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

Hereinafter, embodiments of the present disclosure will be described in detail with reference to the accompanying drawings.

Figure 2:
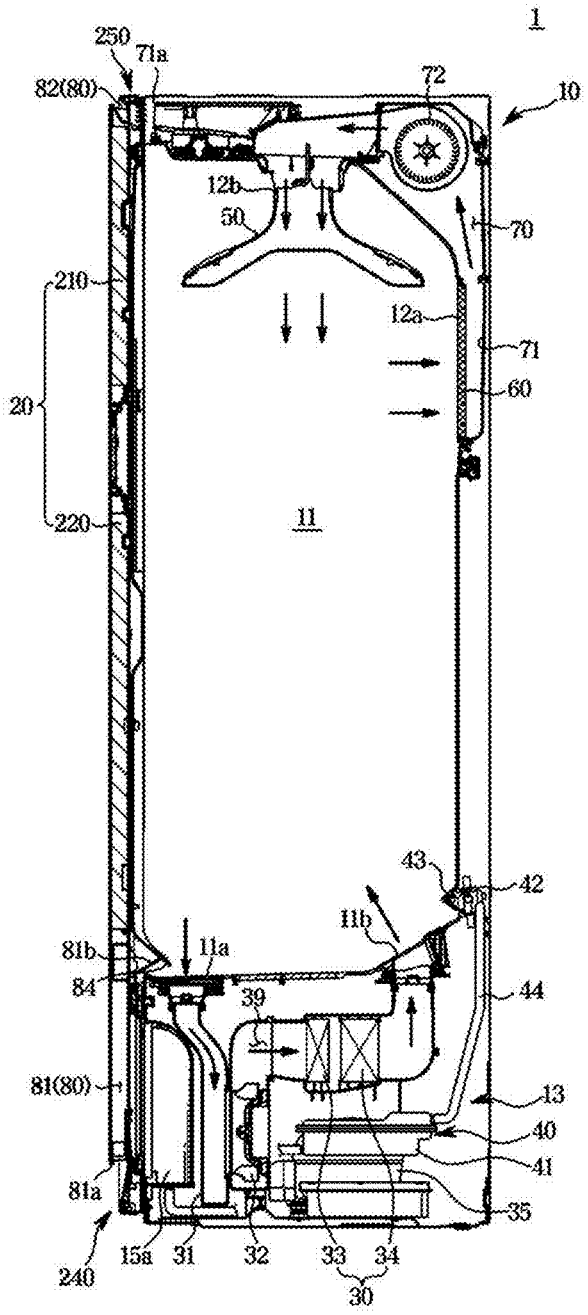
FIG. 2 is a cross-sectional view of the clothes care apparatus according to an embodiment of the present disclosure.
Figure 3:
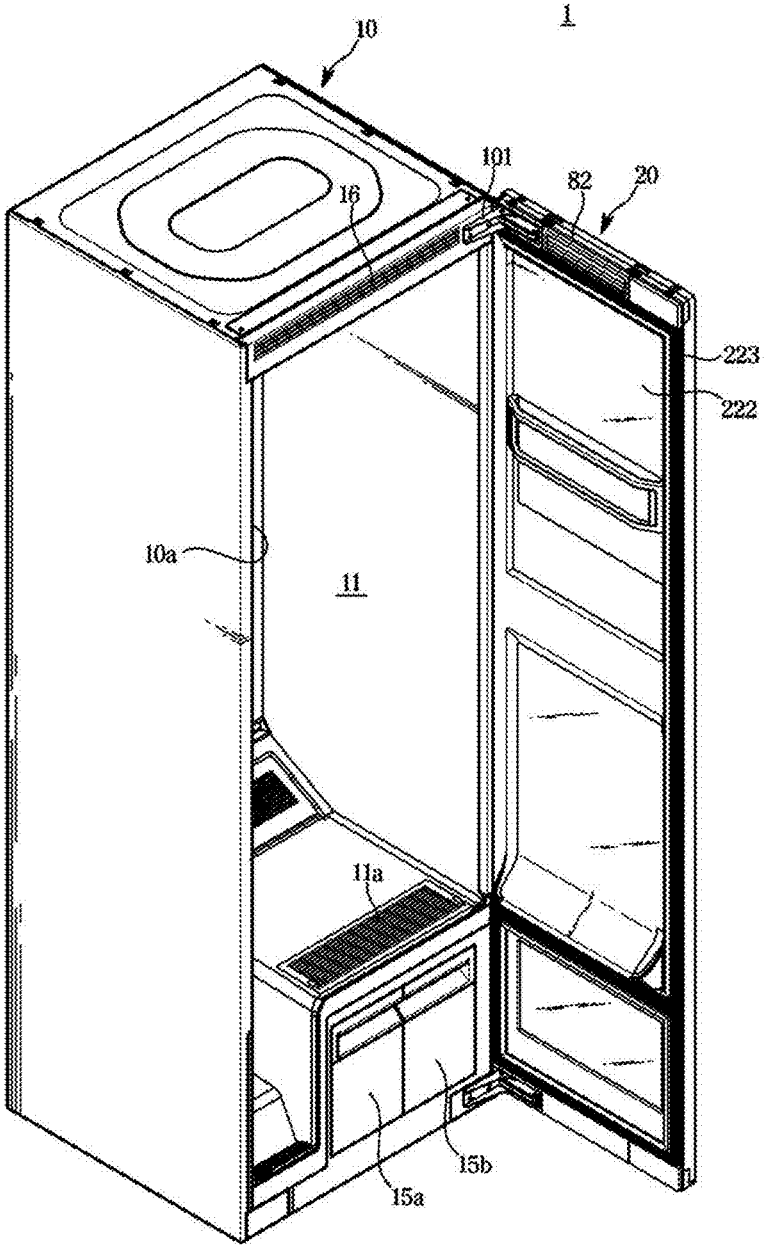
FIG. 3 is a view illustrating an open state of a door of the clothes care apparatus according to an embodiment of the present disclosure.

FIG. 1 is a perspective view of a clothes care apparatus according to an embodiment of the present disclosure, FIG. 2 is a cross-sectional view of the clothes care apparatus according to an embodiment of the present disclosure, and FIG. 3 is a view illustrating an open state of a door of the clothes care apparatus according to an embodiment of the present disclosure.

As illustrated in FIGS. 1 to 3, a clothes care apparatus 1 may include a cabinet 10 forming an exterior, a door 20 rotatably coupled to the cabinet 10, a clothes care compartment 11 provided inside the cabinet 10 to accommodate and care clothes, a clothes support member 50 provided inside the clothes care compartment 11 to hang clothes, a machine compartment 13 in which a heat exchanger 30 provided to dehumidify or heat air in the clothes care compartment 11 is accommodated, and the like.

The cabinet 10 has the clothes care compartment 11 formed therein, and may have a hexahedral shape with an open side. An opening 10*a* may be formed on a front surface of the cabinet 10. The door 20 may be rotatably mounted at the opening 10*a* of the cabinet 10 to open or close the clothes care compartment 11. The door 20 is installed to open or close the clothes care compartment 11. The door 20 may be installed in the cabinet 10 through a connecting member such as a hinge 101.

The clothes care compartment 11 forms a space in which clothes are accommodated. A plurality of discharge slits 16 corresponding to a discharge flow path 82 of the door 20, which will be described later, may be provided at an upper end of the cabinet 10.

The clothes support member 50 may be provided inside the clothes care compartment 11 so that clothes may be hung and supported. The clothes support member 50 may be detachably mounted at an upper side of the clothes care compartment 11. One or more of the clothes support members 50 may be provided. The clothes support member 50 may be formed in the shape of a clothes hanger so that clothes may be hung thereon.

The clothes care compartment 11 may include a first airflow inlet 11*a* and a second airflow inlet 12*a*, a first airflow outlet 11*b* and a second airflow outlet 12*b*, and a steam outlet 43. The second airflow outlet 12*b* of the clothes care compartment 11 may be connected to the clothes support member 50. Air discharged through the second airflow outlet 12*b* is delivered to clothes hung on the clothes support member 50 through an air hole formed in the clothes support member 50.

A drain container 15*a* and a water supply container 15*b* detachably provided in the cabinet 10 may be installed at a lower portion of the cabinet 10. The drain container 15*a* and the water supply container 15*b* may be disposed below the clothes care compartment 11. The drain container 15*a* is provided to facilitate condensed water treatment. The water supply container 15*b* stores water required to generate steam in a steam generator 40, which will be described later. Water in the water supply container 15*b* is supplied to the steam generator 40 and is used to generate steam. The water supply container 15*b* may be detachably installed in the cabinet 10 to facilitate water replenishment.

The drain container 15*a* and the water supply container 15*b* may be provided in front of the machine compartment 13. The machine compartment 13 is provided at the lower portion of the cabinet 10. The machine compartment 13 is provided below the clothes care compartment 11. The machine compartment 13 may include the heat exchanger 30 provided to dehumidify and heat air inside the clothes care compartment 11 as necessary.

A blowing fan 32, the heat exchanger 30 and the steam generator 40 may be disposed inside the machine compartment 13.

The heat exchanger 30 is installed to supply hot air into the clothes care compartment 11. The heat exchanger 30 includes an evaporator 33, a compressor 35, and a condenser 34 through which a refrigerant circulates, and is provided to dehumidify and heat air.

As the refrigerant evaporates in the evaporator 33 of the heat exchanger 30, the evaporator 33 absorbs latent heat of the surrounding air, thereby condensing and removing moisture in the air. Also, when the refrigerant is condensed in the condenser 34 after passing through the compressor 35, the refrigerant heats the surrounding air by releasing the latent heat toward the surrounding air. That is, the evaporator 33 and the condenser 34 perform a heat exchange function, so that the air introduced into the machine compartment 13 by the blowing fan 32 is dehumidified and heated by sequentially passing through the evaporator 33 and the condenser 34.

The heat exchanger 30 installed in the machine compartment 13 includes a first duct 31 connecting the evaporator 33, the condenser 34, and the blowing fan 32, and the first duct 31 may be connected to the clothes care compartment 11 to form a first circulation flow path 39 that circulates between the clothes care compartment 11 and the first duct 31.

The first duct 31 may be connected to the first airflow inlet 11*a* and the first airflow outlet 11*b* of the clothes care compartment 11. The air in the clothes care compartment 11 is introduced into the first duct 31 through the first airflow inlet 11*a*, and the introduced air is dehumidified and discharged back to the clothes care compartment 11 through the first airflow outlet 11*b*.

The first duct 31 is provided to dehumidify the air introduced through the first airflow inlet 11*a* and discharge the dehumidified air to the first airflow outlet 11*b*. The blowing fan 32 is provided on the first duct 31 to suck the air in the clothes care compartment 11 into the first duct 31.

The machine compartment 13 may further include the steam generator 40 to receive water from the water supply container 15*b* to generate steam. The steam generator 40 may be disposed in the machine compartment 13. The steam generator 40 may include a steam generating part 41 connected to the water supply container 15*b* to receive water and generate steam, and a steam supply pipe 44 to guide the generated steam to a steam injector 42. The steam injector 42 may be disposed at a lower portion of a rear surface of the clothes care compartment 11. A heater is installed inside the steam generating part 41 to heat water.

The clothes care compartment 11 may include a blowing device 72 to flow air therein. The clothes care compartment 11 includes a second duct 71, and the blowing device 72 may be installed inside the second duct 71. The second duct 71 may be provided to be in communication with the clothes care compartment 11 to form a second circulation flow path 70 connecting the clothes care compartment 11 and the second duct 71. The blowing device 72 may be disposed on the second circulation flow path 70. The second duct 71 may be formed at the rear of the second airflow inlet 12*a* of the clothes care compartment 11. The second duct 71 is provided at an upper side of the rear surface of the clothes care compartment 11 and may include a filter member 60 therein.

The second duct 71 may be connected to the second airflow inlet 12*a* and the second airflow outlet 12*b* of the clothes care compartment 11. The second airflow outlet 12*b* is connected to the clothes support member 50 so that air in the second duct 71 is delivered to the clothes support member 50.

The blowing device 72 disposed inside the second duct 71 is provided to suck air in the clothes care compartment 11 through the second airflow inlet 12*a* and discharge the sucked air to a second duct outlet 71*a* and the second airflow outlet 12*b*.

When air in the clothes care compartment 11 is introduced into the second duct 71, the air may be filtered by the filter member 60 of the second airflow inlet 12*a*. Dust and odors may be removed from the air introduced into the second duct 71 by the filter member 60.

The care of clothes in the clothes care compartment 11 is performed in a state in which the clothes are supported on the clothes support member 50 and the door 20 is closed. At this time, air may be circulated in the clothes care compartment 11 along the first circulation flow path 39 and the second circulation flow path 70.

The clothes care apparatus 1 includes a dehumidification flow path 80 provided in the door 20 to connect the clothes care compartment 11 and the outside when dehumidifying indoors. The dehumidification flow path 80 may be provided in the door 20. The dehumidification flow path 80 may be provided inside the door 20. The dehumidification flow path 80 may include a suction flow path or inflow path 81 provided in the door 20 to introduce external air into the clothes care compartment 11, and the discharge flow path 82 to discharge the air in the clothes care compartment 11 to the outside.

Figure 4:
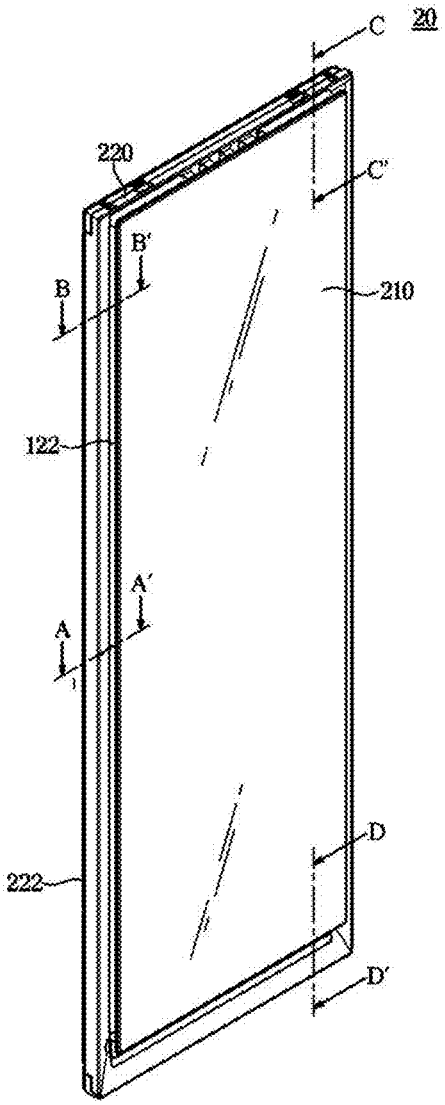
FIG. 4 is a perspective view of the door of the clothes care apparatus according to an embodiment of the present disclosure.
Figure 5:
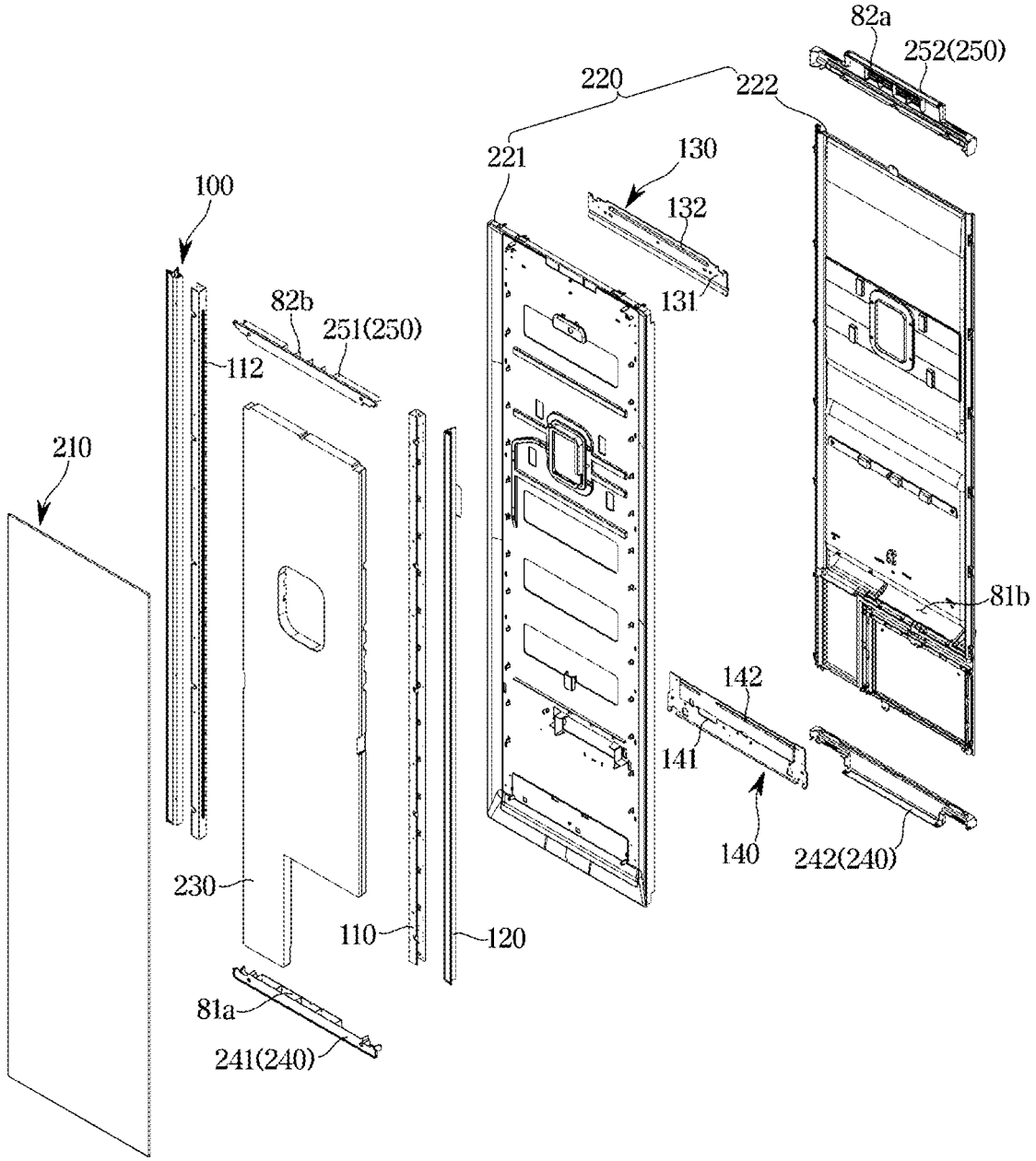
FIG. 5 is an exploded perspective view of the door on which a door support is installed according to an embodiment of the present disclosure.
Figure 6:
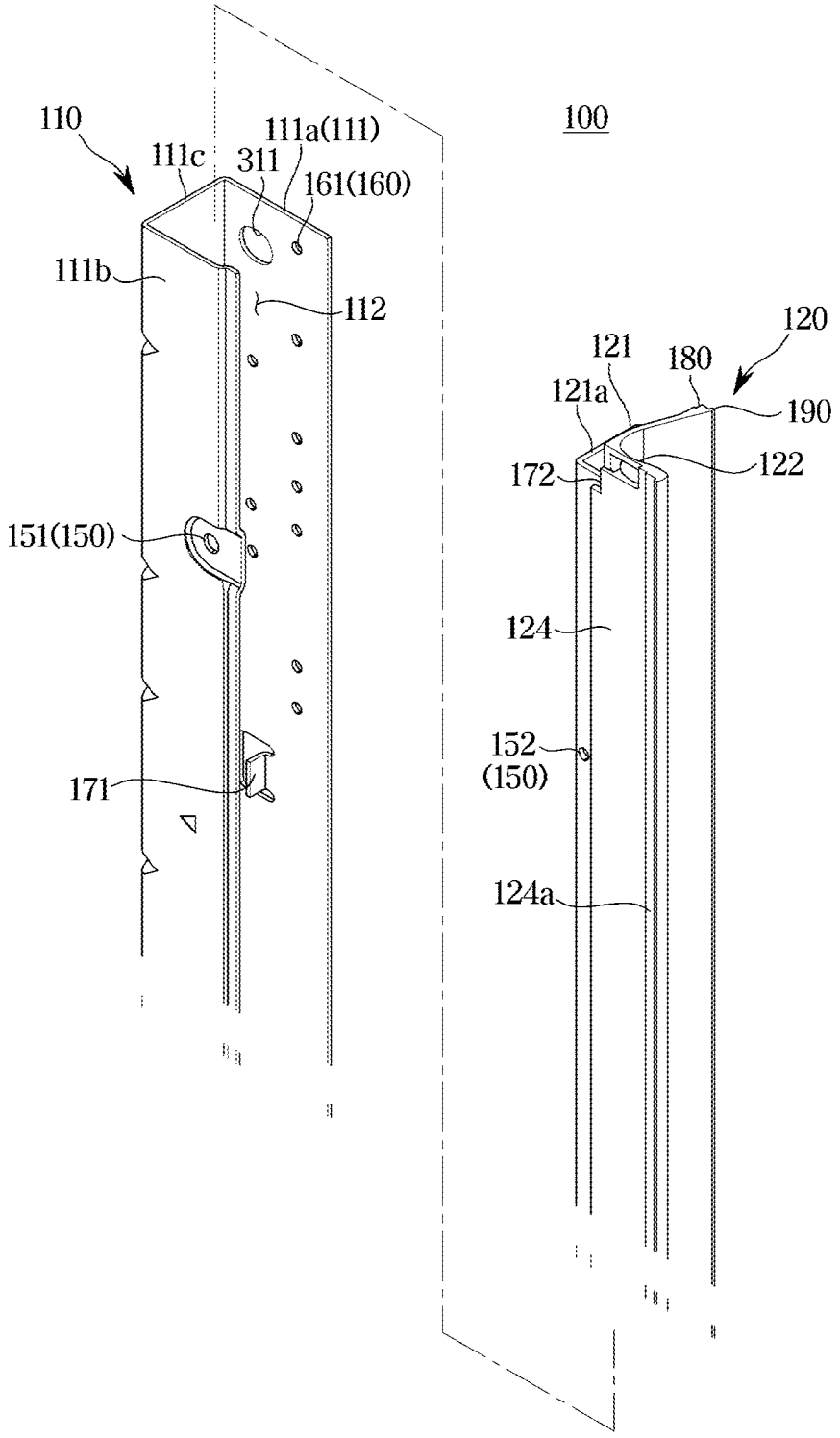
FIG. 6 is a perspective view of a first reinforcement and a second reinforcement of the door support according to an embodiment of the present disclosure.
Figure 7:
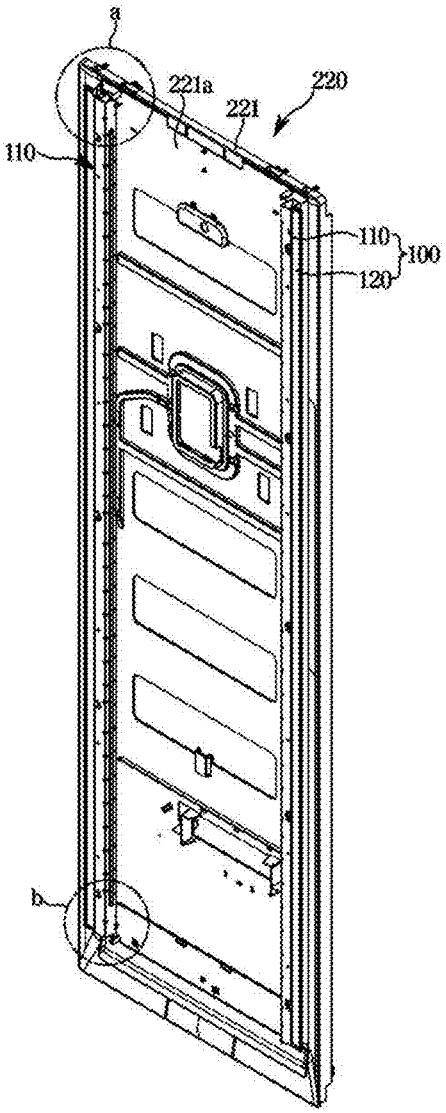
FIG. 7 is a view showing a door member on which the first reinforcement and the second reinforcement are mounted according to an embodiment of the present disclosure.
Figure 8:
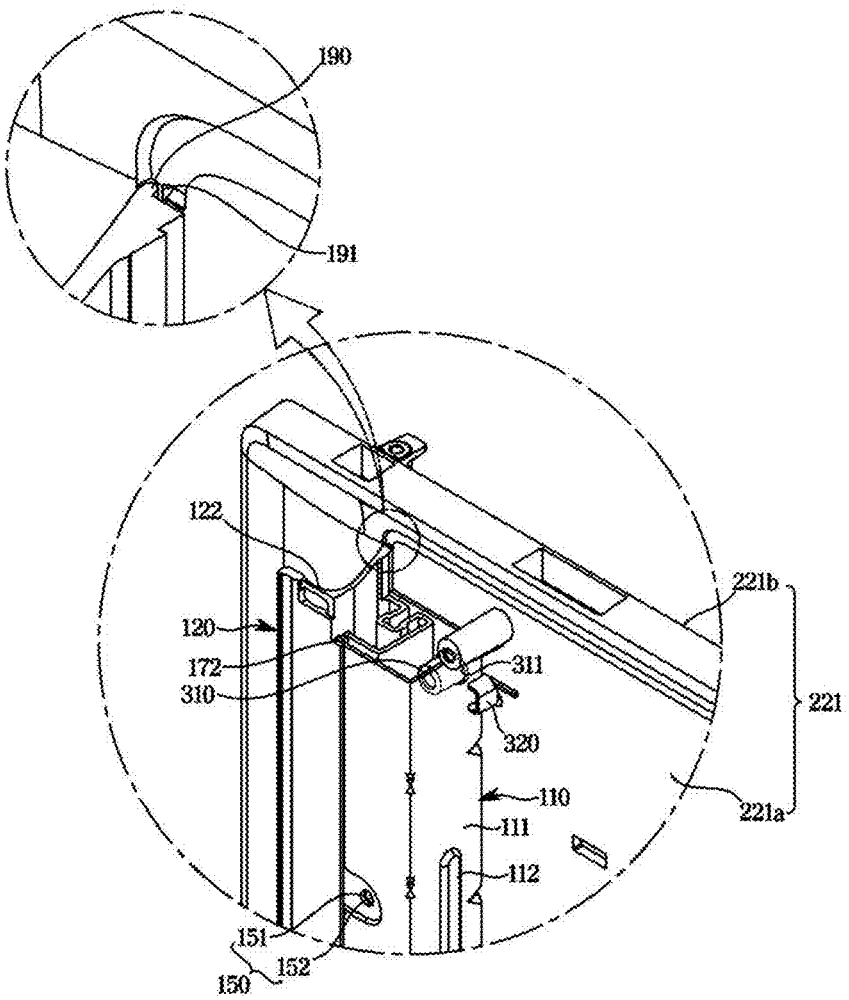
FIG. 8 is an enlarged view of part a in FIG. 7, illustrating that the first reinforcement and the second reinforcement are assembled according to an embodiment of the present disclosure.
Figure 9:
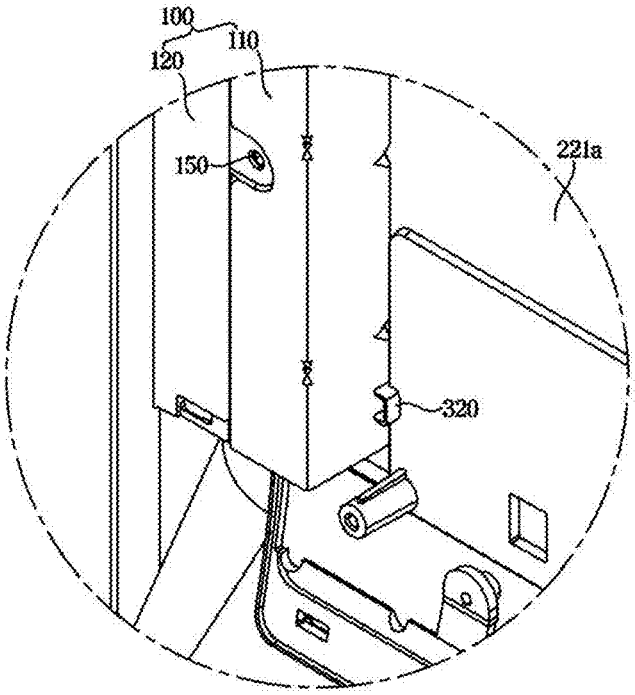
FIG. 9 is an enlarged view of part b in FIG. 7, illustrating a gap prevention guide of the door support according to an embodiment of the present disclosure.
Figure 10:
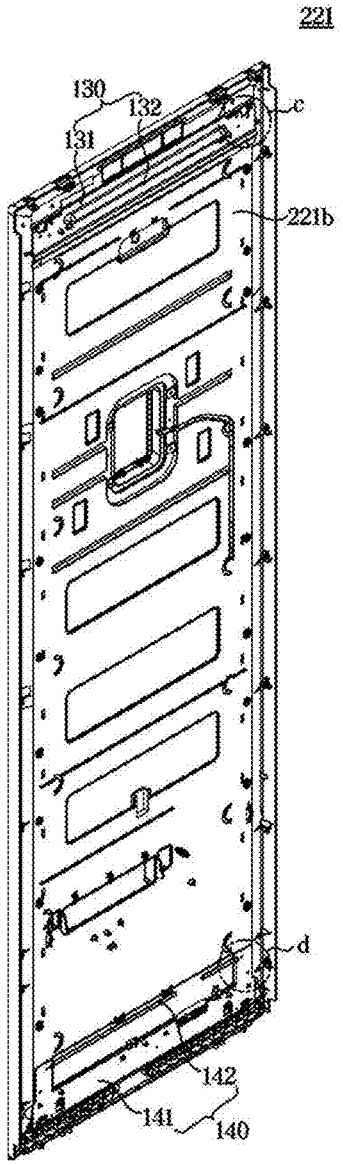
FIG. 10 is a view illustrating a rear surface of the door member on which a third reinforcement and a fourth reinforcement are mounted according to an embodiment of the present disclosure.
Figure 11:
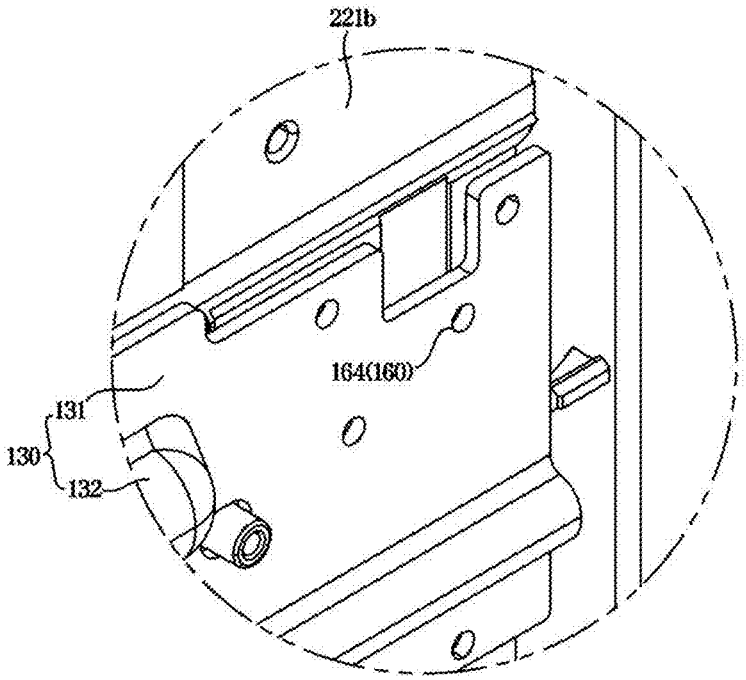
FIG. 11 is an enlarged view of part c in FIG. 10, illustrating that the third reinforcement is assembled according to an embodiment of the present disclosure.
Figure 12:
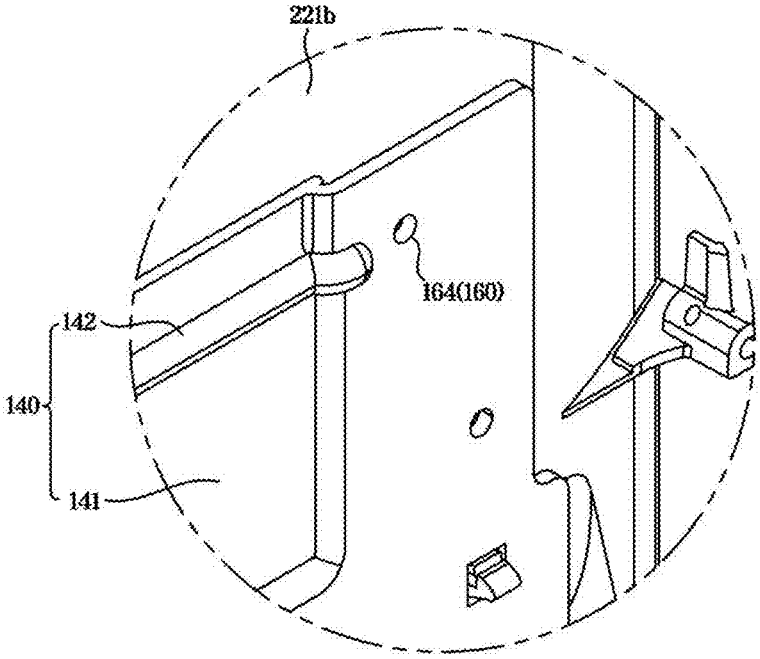
FIG. 12 is an enlarged view of part d in FIG. 10, illustrating that the fourth reinforcement is assembled according to an embodiment of the present disclosure.

FIG. 4 is a perspective view of the door of the clothes care apparatus according to an embodiment of the present disclosure, FIG. 5 is an exploded perspective view of the door on which a door support is installed according to an embodiment of the present disclosure, FIG. 6 is a perspective view of a first reinforcement and a second reinforcement of the door support according to an embodiment of the present disclosure, FIG. 7 is a view showing a door member on which the first reinforcement and the second reinforcement are mounted according to an embodiment of the present disclosure, FIG. 8 is an enlarged view of part a in FIG. 7, illustrating that the first reinforcement and the second reinforcement are assembled according to an embodiment of the present disclosure, FIG. 9 is an enlarged view of part b in FIG. 7, illustrating a gap prevention guide of the door support according to an embodiment of the present disclosure, FIG. 10 is a view illustrating a rear surface of the door member on which a third reinforcement and a fourth reinforcement are mounted according to an embodiment of the present disclosure, FIG. 11 is an enlarged view of part c in FIG. 10, illustrating that the third reinforcement is assembled according to an embodiment of the present disclosure, and FIG. 12 is an enlarged view of part d in FIG. 10, illustrating that the fourth reinforcement is assembled according to an embodiment of the present disclosure. Reference numbers not indicated in the drawings may refer to FIGS. 1 to 3.

As illustrated in FIGS. 4 to 12, the door 20 of the clothes care apparatus 1 may include a door panel 210, and a door frame assembly 220 coupled to the door panel 210 to form a rear surface.

The door panel 210 may form a front surface of the door 20. The door panel 210 may be formed in a plate shape. Various designs and the like may be inserted into the door panel 210 to form the beauty of the product. The door panel 210 may include a mirror, tempered glass, acrylic, glass, plastic, and the like. An embodiment of the present disclosure illustrates that the door panel 210 is a mirror formed in a plate shape, but the present disclosure is not limited thereto. For example, the door panel may include various materials coupled to have a sense of unity with furniture in a room where the clothes care apparatus is installed.

The door frame assembly 220 may be disposed at the rear of the door panel 210. The door frame assembly 220 may be provided to form the exterior of the door 20. The door frame assembly 220 may include a door frame 221 and a rear cover 222 provided at the rear of the door frame 221. The door frame assembly 220 may further include a rear cover 222 provided to form a rear surface of the door 20. The rear cover 222 may be formed to have a corresponding size and shape to cover the rear of the door frame assembly 220. The rear cover 222 may have a corresponding size and shape to cover the rear of the door frame 221.

A sealing member 223 capable of increasing sealing with the cabinet 10 may be provided on the rear cover 222. The sealing member 223 may be provided on a rear surface of the rear cover 222. The sealing member 223 may be formed of an elastic material. The sealing member 223 may include a rubber or silicone material. The sealing member 223 may be formed in a rectangular ring shape. The sealing member 223 may be formed to correspond to the outside of the opening 10*a* of the cabinet 10. The sealing member 223 may be provided such that at least one surface thereof is in contact with the front surface of the cabinet 10 to maintain airtightness with the cabinet 10.

The door panel 210 may be installed in front of the door frame 221. A heat insulator 230 for thermal insulation may be installed between the door frame 221 and the door panel 210. An inflow path 81 of the dehumidification flow path 80 may be provided between the door frame 221 and the door panel 210.

The door 20 may include a first door duct 240 and a second door duct 250. The first door duct 240 may be installed at a lower end of the door 20. The second door duct 250 may be installed at an upper end of the door 20.

The first door duct 240 may form an inflow path 81 that is a part of the dehumidification flow path 80 formed on the door 20. The first door duct 240 may include a first duct cap 241 installed at a lower end of the door frame 221 and a first duct cover 242 corresponding to the first duct cap 241. The first door duct 240 may form a first inlet 81*a*. The air introduced through the first door duct 240 moves through the inflow path 81 and is discharged into the clothes care compartment 11 through a first outlet 81*b* formed on the rear cover 222.

The inflow path 81 may be provided such that the air introduced through the first inlet 81*a* moves. A damping device 84 may be provided at the first outlet 81*b* of the rear cover 222 to open or close the first outlet 81*b*. The air introduced into the inflow path 81 through the first inlet 81*a* by the damping device 84 may be discharged to the clothes care compartment 11 through the first outlet 81*b*.

The dehumidification flow path 80 of the door 20 may include the discharge flow path 82 for discharging air in the clothes care compartment 11 to the outside. The discharge flow path 82 may be provided in the door 20. The discharge flow path 82 may be provided in the second door duct 250 formed at the upper end of the door 20.

The second door duct 250 may include a second duct cap 251 installed at an upper end of the door frame 221 and a second duct cover 252 installed at an upper end of the rear cover 222. The second duct cover 252 and the second duct cap 251 may be formed to correspond to each other.

The second door duct 250 may form the discharge flow path 82. The second duct cover 252 may form a second inlet 82*a*. The air introduced through the second duct cover 252 is discharged to the outside of the door 20 through a second outlet 82*b* using the discharge flow path 82.

A door support 100 may be provided to reinforce the strength of the door 20. The door support 100 may be provided to prevent thermal deformation or torsion occurring during operation of the clothes care apparatus 1. The door 20 may include the door support 100 provided to increase rigidity in a vertical or horizontal direction.

The door support 100 may include a first reinforcement 110 and a second reinforcement 120 provided to support the door 20 in a longitudinal direction, and a third reinforcement 130 and a fourth reinforcement 140 provided to support the door 20 in a transverse direction.

The door support 100 may be provided on the door frame assembly 220 of the door 20. The door support 100 may be provided on the door frame 221. The door support 100 may be provided on a door frame front surface 221*a* and a door frame rear surface 221*b*, respectively.

The first reinforcement 110 and the second reinforcement 120 may be installed on the door frame front surface 221*a*. The first reinforcement 110 and the second reinforcement 120 may be installed on left and right sides of the door frame front surface 221*a*. The first reinforcement 110 and the second reinforcement 120 may be coupled to each other to form a vertical reinforcement.

The third reinforcement 130 and the fourth reinforcement 140 may be installed on the door frame rear surface 221*b*. The third reinforcement 130 and the fourth reinforcement 140 may be installed on an upper side and a lower side of the door frame rear surface 221*b*, respectively.

The third reinforcement 130 and the fourth reinforcement 140 may be provided to support the door frame rear surface 221*b* in the transverse direction. The third reinforcement 130 and the fourth reinforcement 140 may be provided on the upper side and the lower side of the door frame rear surface 221*b*, respectively. The third reinforcement 130 and the fourth reinforcement 140 may be coupled to the door frame 221 to form a horizontal reinforcement, respectively.

The first reinforcement 110 and the second reinforcement 120 may be disposed on the door frame front surface 221*a*. The first reinforcement 110 and the second reinforcement 120 may be provided to increase the rigidity of the door 20 in the longitudinal direction. The first reinforcement 110 and the second reinforcement 120 may be provided to be connected to each other. The first reinforcement 110 may be formed in a bar shape corresponding to the longitudinal direction or having a small length so as to support the door 20 in the longitudinal direction. The second reinforcement 120 may be provided to be connected to one side of the first reinforcement 110. At least a portion of the second reinforcement 120 may be provided to be exposed to the outside of the door 20. The second reinforcement 120 may be formed to have a length corresponding to the first reinforcement 110.

The first reinforcement 110 and the second reinforcement 120 may be coupled to each other in a sliding manner. The first reinforcement 110 and the second reinforcement 120 may be combined and mounted on the door frame 221 of the door 20. The first reinforcement 110 and the second reinforcement 120 may be provided as a pair coupled to each other. The first reinforcement 110 and the second reinforcement 120 provided as a pair may be disposed on the left and right sides of the door 20, respectively. The first reinforcement 110 and the second reinforcement 120 provided as a pair may be formed symmetrically to the left and right and installed on the left and right sides of the door 20, respectively.

The first reinforcement 110 may include a first reinforcing body 111 having a bar shape. The first reinforcing body 111 may be provided with a first reinforcing body opening 112 formed at one side thereof so that the second reinforcement 120 may be connected thereto. The second reinforcement 120 may be coupled through the first reinforcing body opening 112.

The first reinforcing body 111 may include a first surface 111*a*, a second surface 111*b*, and a third surface 111*c* connecting the first surface 111*a* and the second surface 111*b*. The first surface 111*a* and the second surface 111*b* may be disposed to be spaced apart from each other and face each other. The first reinforcing body 111 may be formed in a substantially 'C' shape. The first surface 111*a* of the first reinforcing body 111 may be disposed on the door frame assembly 220 side, and the second surface 111*b* may be disposed on the door panel 210 side. The third surface 111*c* is provided to connect between the first surface 111*a* and the second surface 111*b*, and may include at least one bead. An embodiment of the present disclosure illustrates that the bead is one protrusion that protrudes long in the longitudinal direction, but the present disclosure is not limited thereto. For example, the bead may include a plurality of protrusions formed in the horizontal direction of the third surface.

A fixing portion 160 for fixing with the second reinforcement 120 may be formed on the first surface 111*a* of the first reinforcing body 111. The fixing portion 160 may include a first fixing portion 161, a second fixing portion 162, a third fixing portion 163, and a fourth fixing portion 164 for fixing the first reinforcement 110 to the second reinforcement 120, the door frame assembly 220, and the third reinforcement 130, which will be described later, respectively. The first fixing portion 161 may be formed on the first surface 111*a* of the first reinforcing body 111. The fixing portion 160 may include a hole for fixing a fixing member such as a screw.

A reinforcement assembly 150 for assembling with the second reinforcement 120 may be formed on the second surface 111*b* of the first reinforcement body 111. The reinforcement assembly 150 may be formed such that the first reinforcement 110 and the second reinforcement 120 are assembled. The reinforcement assembly 150 may include a first reinforcement assembly 151 provided on the first reinforcement 110 and a second reinforcement assembly 152 provided on the second reinforcement 120. One or more of the first reinforcement assemblies 151 may be provided. The second reinforcement assembly 152 may be formed at a position corresponding to the first reinforcement assembly 151.

The first reinforcement 110 may be formed of a steel material. The first reinforcement 110 may be formed by press forming. The first reinforcement 110 may include a first assembling guide 171 formed to guide the assembly of the second reinforcement 120. The first assembling guide 171 may be formed on the first surface 111*a*. A plurality of the first assembling guides 171 may be provided. The first assembling guide 171 may be formed by bending from the first surface 111*a* to the second surface 111*b* side. The first assembling guide 171 may be connected to an assembly hook 221*c* of the door frame assembly 220, which will be described later. Specifically, the first assembling guide 171 is provided such that the first assembling guide 171 may be caught on the assembly hook 221*c* formed on the door frame assembly 220 when the first reinforcement 110 and the second reinforcement 120 are assembled to the door frame assembly 220. The assembly hook 221*c* may be formed on the door frame 221. The assembly hook 221*c* may be formed to protrude from the door frame front surface 221*a*. The assembly hook 221*c* may be formed to correspond to the first assembling guide 171. The assembly hook 221*c* is formed to protrude from the door frame front surface 221*a*, so that the first assembling guide 171 of the first reinforcement 110 may be caught thereon.

The second reinforcement 120 may include a second reinforcing body 121 having a bar shape. The second reinforcing body 121 may include a corresponding second reinforcing body supporting part 121*a* so that the first reinforcement 110 may be connected to one side thereof. The second reinforcing body supporting part 121*a* may be coupled to the first reinforcement 110 by being inserted into the first reinforcing body opening 112 in a sliding manner. The second reinforcement assembly 152 corresponding to the first reinforcement assembly 151 may be formed on the second reinforcing body supporting part 121*a*. This embodiment illustrates that the second reinforcement assembly 152 is formed on the second reinforcing body supporting part 121*a*, but the present disclosure is not limited thereto. The second reinforcement assembly may be formed on at least a portion of the second reinforcement.

The second reinforcing body 121 of the second reinforcement 120 may further include a stopper 180 provided to limit the movement of the first reinforcement 110 when assembled with the first reinforcement 110. The stopper 180 may be formed to support an end of the first surface 111*a*. The stopper 180 may be formed at at least a portion of the second reinforcing body 121.

The second reinforcement 120 may include the fixing portion 160 for fixing with the first reinforcement 110 and the door frame assembly 220. The second reinforcement 120 may include the second fixing portion 162, which will be described later. The second fixing portion 162 may be formed at a position corresponding to the first fixing portion 161.

The second reinforcing body 121 may include a second assembling guide 172 provided to guide the movement of the second surface 111*b* of the first reinforcement 110. The second assembling guide 172 may be formed between the second reinforcing body supporting part 121*a* of the second reinforcing body 121 and a door panel installation part 124. The second assembling guide 172 may be formed to guide the second surface 111*b* of the first reinforcement 110.

At least a portion of the second reinforcement 120 may include a handle 122 provided to be exposed to the outside of the door 20. At least a portion of the second reinforcing body 121 may include the handle 122 provided to be exposed to the outside of the door 20. The handle 122 may be provided on one side of the second reinforcing body 121. The handle 122 may be formed in a curved shape to be gripped by a user.

The second reinforcement 120 may include at least one of steel, aluminum, and an injection-molded part. The second reinforcement 120 may form an exterior by being exposed to the outside of the door 20. The second reinforcement 120 may be formed by extrusion molding. The second reinforcement 120 may have a thickness smaller than that of the first reinforcement 110 when it is formed of steel.

The second reinforcement 120 may include the door panel installation part 124 so that the door panel 210 is installed in front thereof. The door panel installation part 124 may be formed on a front surface of the second reinforcement 120. The second reinforcement 120 may further include an adhesive 124*a* formed such that the door panel 210 may be adhered thereto. The adhesive 124*a* may be formed at an outer edge of the door panel installation part 124.

As illustrated in FIGS. 8 to 9, the first reinforcement 110 and the second reinforcement 120 of the door support 100 may be installed on the door frame front surface 221*a* of the door frame 221.

A position guide boss 310 for coupling the first reinforcement 110 and the second reinforcement 120 may be formed on the door frame front surface 221*a*. The position guide boss 310 may be formed on an upper side and a lower side of the door frame front surface 221*a*, respectively. The position guide boss 310 may be formed as a protrusion having a cylindrical shape. A position guide hole 311 to which the position guide boss 310 is coupled may be formed on the first surface 111*a* of the first reinforcement 110. The position guide hole 311 may be formed on an upper side and a lower side of the first surface 111*a*, respectively. As the position guide boss 310 is inserted into the position guide hole 311, the first reinforcement 110 and the second reinforcement 120 coupled to the first reinforcement 110 may be installed to the door frame 221.

A gap prevention rib 320 may be formed on the door frame front surface 221*a* to prevent a left and right gap from being generated when the first reinforcement 110 and the second reinforcement 120 are assembled. The gap prevention rib 320 may be formed to support at least one surface of the first reinforcement 110. The gap prevention rib 320 may be disposed to support the third surface 111*c* of the first reinforcing body 111. The gap prevention rib 320 may be formed to protrude from the door frame front surface 221*a*. The gap prevention rib 320 may prevent the first reinforcement 110 and the second reinforcement 120 from moving in the horizontal direction by supporting the third surface 111*c* of the first reinforcing body 111.

A position guide groove 191 may be formed on the door frame front surface 221*a* to guide a position of the second reinforcement 120. The position guide groove 191 may be formed in the longitudinal direction on both sides of the door frame front surface 221*a*. A position guide protrusion 190 corresponding to the position guide groove 191 may be formed on the second reinforcing body 121 of the second reinforcement 120. The position guide protrusion 190 may be formed to protrude from an end of the second reinforcing body 121. The position guide protrusion 190 may guide the second reinforcement 120 to be installed at an accurate position on the door frame 221.

As illustrated in FIGS. 10 to 12, the third reinforcement 130 and the fourth reinforcement 140 of the door support 100 may be installed on the door frame rear surface 221*b* of the door frame 221.

The door support 100 may include the third reinforcement 130 and the fourth reinforcement 140 provided to reinforce a transverse rigidity of the door 20.

The third reinforcement 130 and the fourth reinforcement 140 may be disposed on a rear surface of the door frame assembly 220. The third reinforcement 130 and the fourth reinforcement 140 may be disposed at the rear of the door frame 221. The third reinforcement 130 and the fourth reinforcement 140 may be coupled to the door frame rear surface 221*b*. The third reinforcement 130 may be disposed at the upper side of the door frame rear surface 221*b*. The fourth reinforcement 140 may be disposed at the lower side of the door frame rear surface 221*b*.

The third reinforcement 130 may be formed in a plate shape. The third reinforcement 130 may be provided to be supported in the transverse direction on a rear surface of the door frame 221. The third reinforcement 130 may be formed to correspond to a transverse direction of the door frame 221 or to be smaller. The third reinforcement 130 may include a third reinforcing body 131 having a plate shape. At least a portion of the third reinforcing body 131 may be provided with a first protrusion 132 formed in the transverse direction. The first protrusion 132 may be formed to protrude long in a transverse direction of the third reinforcing body 131 (refer to FIG. 15). In the embodiment of the present disclosure, the first protrusion is illustrated as a groove protruding rearward in a circular cross-section thereof, but the present disclosure is not limited thereto. For example, the cross-section of the first protrusion may include a square or triangular shape. In addition, a plurality of the first protrusions may be disposed to be spaced apart from each other in a longitudinal direction of the third reinforcing body.

The fourth fixing portion 164 may be provided on the third reinforcing body 131. The fourth fixing portion 164 may be formed at a position corresponding to the first fixing portion 161 of the first reinforcement 110, the second fixing portion 162 of the second reinforcement 120, and the third reinforcement 130 of the door frame 221. A fixing member (not shown) passing through the fourth fixing portion 164 may be fixed to the first reinforcement 110 by sequentially passing through the third reinforcement 130, the door frame assembly 220, and the second reinforcement 120.

The fourth reinforcement 140 may be formed in a plate shape. The fourth reinforcement 140 may be provided to be supported in the transverse direction on the rear surface of the door frame 221. The fourth reinforcement 140 may be formed to correspond to the transverse direction of the door frame or to be smaller. The fourth reinforcement may include a fourth reinforcing body 141 having a plate shape.

At the fourth reinforcing body 141 may be provided with a second protrusion 142 formed in the transverse direction. The second protrusion 142 may be formed to protrude long in a transverse direction of the fourth reinforcing body 141 (refer to FIG. 16). The embodiment of the present disclosure illustrates that the single second protrusion is formed to be long, but the present disclosure is not limited thereto. For example, a plurality of the second protrusions may be provided.

Figure 13:
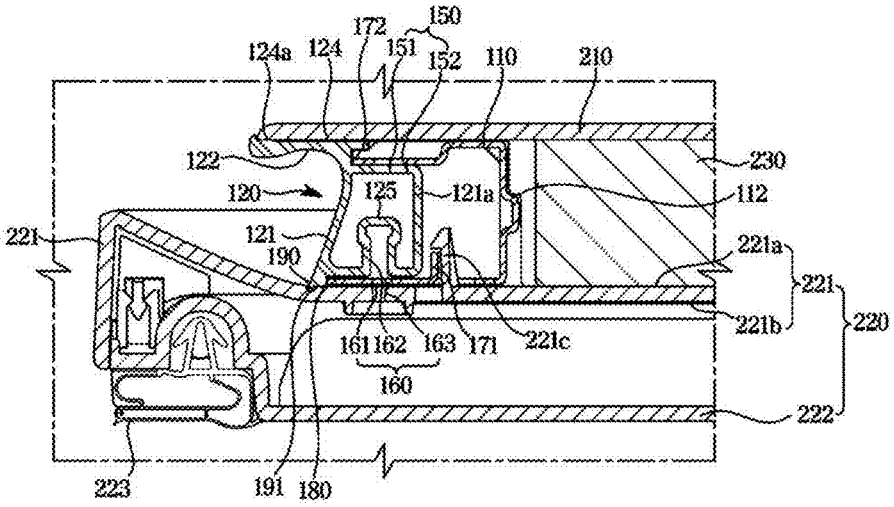
FIG. 13 is a cross-sectional view taken along a line A-A' in FIG. 4, illustrating a state in which the door support is coupled according to an embodiment of the present disclosure.
Figure 14:
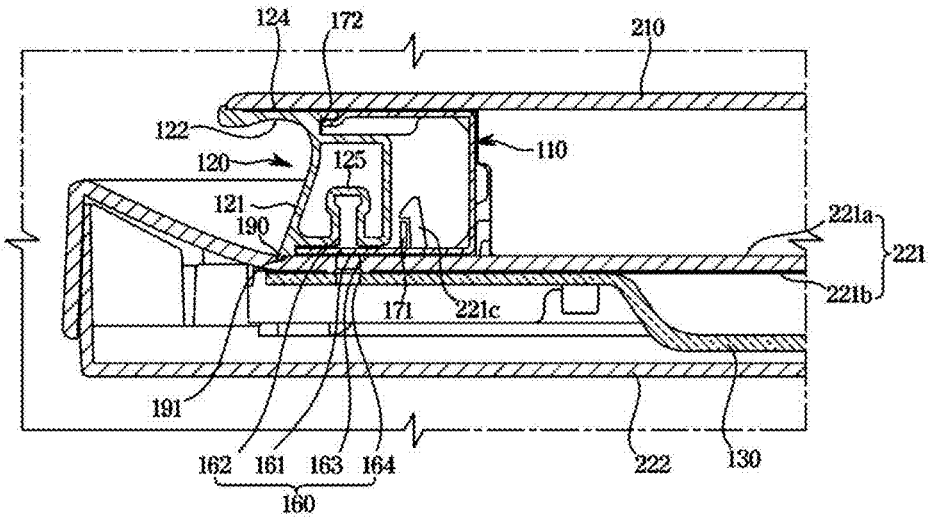
FIG. 14 is a cross-sectional view taken along a line B-B' in FIG. 4, illustrating a state in which the door support is coupled according to an embodiment of the present disclosure.
Figure 15:
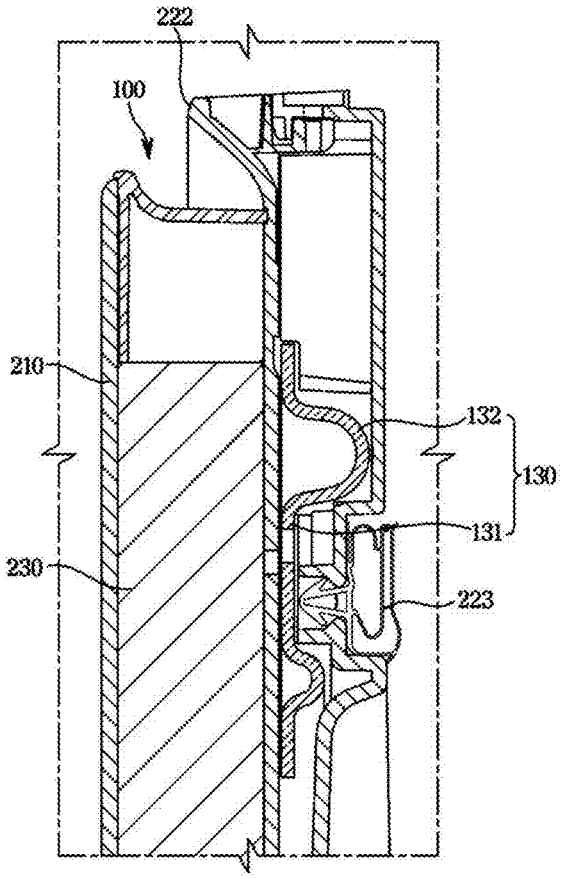
FIG. 15 is a cross-sectional view taken along a line C-C' in FIG. 4, illustrating a state in which the third reinforcement and the first reinforcement are coupled according to an embodiment of the present disclosure.
Figure 16:
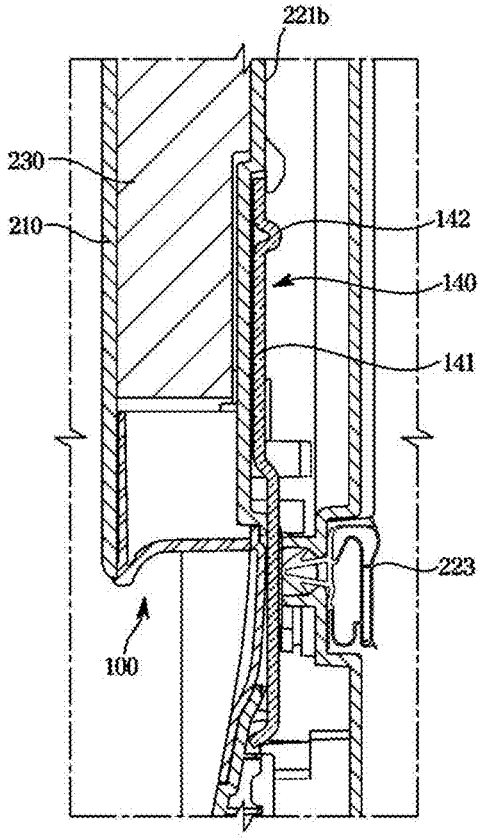
FIG. 16 is a cross-sectional view taken along a line D-D' in FIG. 4, illustrating a state in which the fourth reinforcement and the first reinforcement are coupled according to an embodiment of the present disclosure.

FIG. 13 is a cross-sectional view taken along a line A-A' in FIG. 4, illustrating a state in which the door support is coupled according to an embodiment of the present disclosure, FIG. 14 is a cross-sectional view taken along a line B-B' in FIG. 4, illustrating a state in which the door support is coupled according to an embodiment of the present disclosure, FIG. 15 is a cross-sectional view taken along a line C-C' in FIG. 4, illustrating a state in which the third reinforcement and the first reinforcement are coupled according to an embodiment of the present disclosure, and FIG. 16 is a cross-sectional view taken along a line D-D' in FIG. 4, illustrating a state in which the fourth reinforcement and the first reinforcement are coupled according to an embodiment of the present disclosure. Reference numbers not indicated in the drawings may refer to FIGS. 1 to 12.

As illustrated in FIGS. 13 to 16, the first reinforcement 110 and the second reinforcement 120 may be fixed to the door frame 221 of the door frame assembly 220 by the fixing portion 160.

The fixing portion 160 may be provided to fix the first reinforcement 110, the second reinforcement 120, and the third reinforcement 130 to the door frame assembly 220.

The fixing portion 160 may include the first fixing portion 161, the second fixing portion 162, the third fixing portion 163, and the fourth fixing portion 164 to fix the first reinforcement 110 to the second reinforcement 120, the door frame assembly 220, and the third reinforcement 130, respectively, which will be described later. The fixing portion 160 may include a hole for fixing a fixing member such as a screw.

The first fixing portion 161 may be formed on the first surface 111*a* of the first reinforcement 110.

The second fixing portion 162 may be formed on the second reinforcement 120. The second fixing portion 162 may be formed at a position corresponding to the first fixing portion 161. The second fixing portion 162 of the second reinforcement 120 may be formed at a position corresponding to the first fixing portion 161 of the first reinforcement 110. The second fixing portion 162 of the second reinforcement 120 may be formed such that a fixing member (not shown) passing through the first fixing portion 161 is fixed to the second fixing portion 162. The second fixing portion 162 of the second reinforcement 120 may include a reinforcing protrusion 125 formed to extend. The reinforcing protrusion 125 may be formed to protrude inward of the second fixing portion 162. The reinforcing protrusion 125 may be formed in a longitudinal direction of the door 20.

The third fixing portion 163 corresponding to the first fixing portion 161 and the second fixing portion 162 may be formed on the door frame assembly 220. The third fixing portion 163 may be provided on the door frame 221. The third fixing portion 163 may be formed such that the first reinforcement 110 and the second reinforcement 120 may be fixed to the door frame 221. The first reinforcement 110 and the second reinforcement 120 may be fixed to the door frame assembly 220 by a fixing member (not shown) passing through the third fixing portion 163.

The first reinforcement 110 and the second reinforcement 120 are assembled to the door frame 221 of the door frame assembly 220 in a state in which the first reinforcement 110 and the second reinforcement 120 are connected to each other through the reinforcement assembly 150. At this time, the first assembling guide 171 of the first reinforcement 110 may be coupled by being caught on the assembly hook 221*c* of the door frame 221. The first reinforcement 110 and the second reinforcement 120 in a temporarily fixed state as above may be completely fixed through the fixing portion 160.

As illustrated in FIG. 14, the fixing portion 160 may include the fourth fixing portion 164 formed on the third reinforcement 130 to fix the first reinforcement 110, the second reinforcement 120, and the third reinforcement 130 to the door frame assembly 220.

The fourth fixing portion 164 may be formed on the third reinforcement 130. The fourth fixing portion 164 may be formed at a position corresponding to the first fixing portion 161 of the first reinforcement 110, the second fixing portion 162 of the second reinforcement 120, and the third reinforcement 130 of the door frame 221. The fixing member (not shown) passing through the fourth fixing portion 164 may be fixed to the first reinforcement 110 by sequentially passing through the third reinforcement 130, the door frame assembly 220, and the second reinforcement 120.

As such, the first reinforcement 110, the second reinforcement 120, and the third reinforcement 130 mutually fixed through the first fixing portion 161 to the fourth fixing portion 164 may strengthen the rigidity of the door 20 by being firmly fixed to the door frame assembly 220.

The fourth fixing portion 164 may be provided on the fourth reinforcing body 141 of the fourth reinforcement 140. The fourth fixing portion 164 may be formed at a position corresponding to the first fixing portion 161 of the first reinforcement 110, the second fixing portion 162 of the second reinforcement 120, and the third reinforcement 130 of the door frame 221. Accordingly, the fixing member (not shown) passing through the fourth fixing portion 164 may be fixed to the first reinforcement 110 by sequentially passing through the third reinforcement 130, the door frame assembly 220, and the second reinforcement 120.

The first reinforcement 110 and the second reinforcement 120, which are disposed in front of the door frame 221 through the first to fourth fixing portions 160, and the third reinforcement 130, which is disposed in the rear of the door frame 221, may be fastened at once. Also, the first reinforcement 110 and the second reinforcement 120, which are disposed in front of the door frame 221 through the first to fourth fixing portions 160, and the fourth reinforcement 140, which is disposed in the rear of the door frame 221, may be fixed by being fastened at once.

Through the fixing structure as described above, the door support 100 may be firmly fixed, and thus the rigidity thereof may be reinforced.

In addition, because at least a portion of the door support 100 may be exposed to the outside of the door 20, the reinforcement and the design may be complemented at the same time, thereby reducing the cost.

The foregoing has illustrated and described specific embodiments. However, it should be understood by those of skilled in the art that the disclosure is not limited to the above-described embodiments, and various changes and modifications may be made without departing from the technical idea of the disclosure described in the following claims.

Although the present disclosure has been described with various embodiments, various changes and modifications may be suggested to one skilled in the art. It is intended that the present disclosure encompass such changes and modifications as fall within the scope of the appended claims.

What is claimed is:

1. A clothes care apparatus comprising:

a cabinet comprising:

a clothes care compartment with an open front, and a machine compartment provided with a heat pump and a steam generator provided to heat or dehumidify air in the clothes care compartment;

a door provided to open or close an opening of the cabinet, wherein the door comprises a door panel forming a front surface of the door and a door frame assembly coupled to the door panel to form a rear surface of the door, wherein the door frame assembly comprises a section of metal having a first side proximate to the clothes care compartment, and wherein the first side of the door frame assembly is heated by heat from the heat pump and steam generator to the clothes care compartment; and a door support provided to reinforce a rigidity of the door, wherein the door support comprises:

a first reinforcement positioned between the door panel and the door frame assembly, the first reinforcement configured to support the door in a longitudinal direction, the first reinforcement including a first reinforcing body with a first reinforcing body opening, and a second reinforcement connected to a side of the first reinforcement through the first reinforcing body opening in a sliding manner and having a same length in the longitudinal direction as the first reinforcement, the second reinforcement including an exposed portion exposed to an outside of the door that is opposite to the side connected to the first reinforcement;

a heat insulator provided as a panel between the door panel and the door frame assembly, wherein the heat insulator has a thickness substantially similar to a thickness of the door support.

2. The clothes care apparatus according to claim 1, wherein the first reinforcement comprises a steel material.

3. The clothes care apparatus according to claim 2, wherein the second reinforcement comprises at least one of steel, aluminum, and an injection-molded part.

4. The clothes care apparatus according to claim 3, wherein:

the first reinforcement is molded by a press method, and the second reinforcement is molded by an extrusion method.

5. The clothes care apparatus according to claim 1, wherein the door support comprises a third reinforcement and a fourth reinforcement disposed to support the door in a transverse direction.

6. The clothes care apparatus according to claim 5, wherein the third reinforcement and the fourth reinforcement are disposed on the rear surface of the door frame assembly.

7. The clothes care apparatus according to claim 6, wherein the third reinforcement and the fourth reinforcement each comprise at least one protrusion.

8. The clothes care apparatus according to claim 1, wherein the first reinforcement and the second reinforcement comprise a fixing portion to be fixed to the door frame assembly.

9. The clothes care apparatus according to claim 1, wherein the first reinforcement comprises a first assembling guide configured to guide a first reinforcement assembly with the door frame assembly.

10. The clothes care apparatus according to claim 9, wherein the second reinforcement further comprises a second assembling guide configured to guide a second reinforcement assembly with the first reinforcement.

11. The clothes care apparatus according to claim 10, wherein the second reinforcement further comprises a stopper configured to limit movement of the first reinforcement when assembled with the first reinforcement.

12. The clothes care apparatus according to claim 1, wherein at least one of the second reinforcement and the door frame assembly includes an adhesive configured to adhere the door panel.

13. The clothes care apparatus according to claim 1, wherein the second reinforcement comprises a handle.

14. The clothes care apparatus according to claim 1, further comprising:

a reinforcement assembly configured to assemble the first reinforcement to the second reinforcement.

15. A clothes care apparatus including:

a cabinet in which a clothes care compartment is formed, wherein the clothes care compartment is heated by one or more heat sources;

an insulated door installed in the cabinet to open or close the clothes care compartment, wherein the insulated door comprises a door panel forming a front surface of the door and a metal door frame assembly coupled to the door panel to form a rear surface of the door, wherein the rear surface of the door is exposed to heat in the clothes care compartment; and at least one door support provided to reinforce a rigidity of the insulated door, wherein the door support includes:

a first reinforcement of a steel material provided in a longitudinal direction of the door and positioned between the door panel and the metal door frame assembly, the first reinforcement including a first reinforcing body with a first reinforcing body opening, a second reinforcement connected to one side of the first reinforcement through the first reinforcing body opening in a sliding manner and having a same length in the longitudinal direction as the first reinforcement, the second reinforcement provided such that at least a portion thereof is exposed to an outside of the insulated door that is opposite to the side connected to the first reinforcement, and wherein the door support occupies a part of a space between the door panel and the metal door frame assembly also containing insulation of the insulated door.

16. The clothes care apparatus of claim 15, wherein the second reinforcement includes at least one of steel, aluminum, and an injection-molded part.

17. The clothes care apparatus of claim 15, wherein:

the first reinforcement is molded by a press method, and the second reinforcement is molded by an extrusion method.

* * * * *